United States Patent [19]

Bottomley

[11] Patent Number: 4,499,625

[45] Date of Patent: Feb. 19, 1985

[54] TWO-WAY GUN CLEANER TIP AND BUTTERFLY PATH FOR USE THEREWITH

[76] Inventor: C. Edward Bottomley, 130 Griffin Rd., West Suffield, Conn. 06093

[21] Appl. No.: 544,958

[22] Filed: Oct. 24, 1983

[51] Int. Cl.[3] ..... F41C 31/00

[52] U.S. Cl. ..... 15/104.165; 15/211

[58] Field of Search ..... 15/104.165, 208, 209 R, 15/210 R, 211, 212, 213, 228, 229

[56] References Cited

U.S. PATENT DOCUMENTS

| | | | |
|---|---|---|---|
| 613,860 | 11/1898 | Howard | 15/104.165 |
| 1,164,564 | 12/1915 | Yost | 15/104.165 |
| 1,665,988 | 4/1928 | Smith | 15/104.165 |
| 2,682,073 | 6/1954 | Hoffman | 15/211 |
| 4,114,224 | 9/1978 | Disko | 15/229 R |

*Primary Examiner*—Edward L. Roberts
*Assistant Examiner*—Arthur D. Dahlberg
*Attorney, Agent, or Firm*—Ross, Ross & Flavin

[57] ABSTRACT

A gun cleaner comprises a rod and a patch associated therewith. The rod is an elongated member for extending through a gun barrel and has an outboard terminal of enlarged diameter. The enlarged terminal has a midsection with flattened opposite sides defining depressions extending inboard of the terminal surface and a through patch-receiving opening extending through the midsection. The patch is of a flexible member and has slits on opposite sides which extend inwardly toward the center for facilitating the extending of the patch through the patch-receiving opening in the midsection for the outward flaring of the sides of the patch at opposite sides of the rod.

2 Claims, 13 Drawing Figures

10
20
22
24
26
50
52
54
56
60
62
63
64
66
68

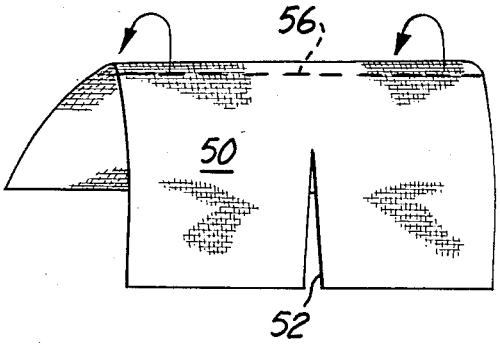
FIG. 11
FIG. 12
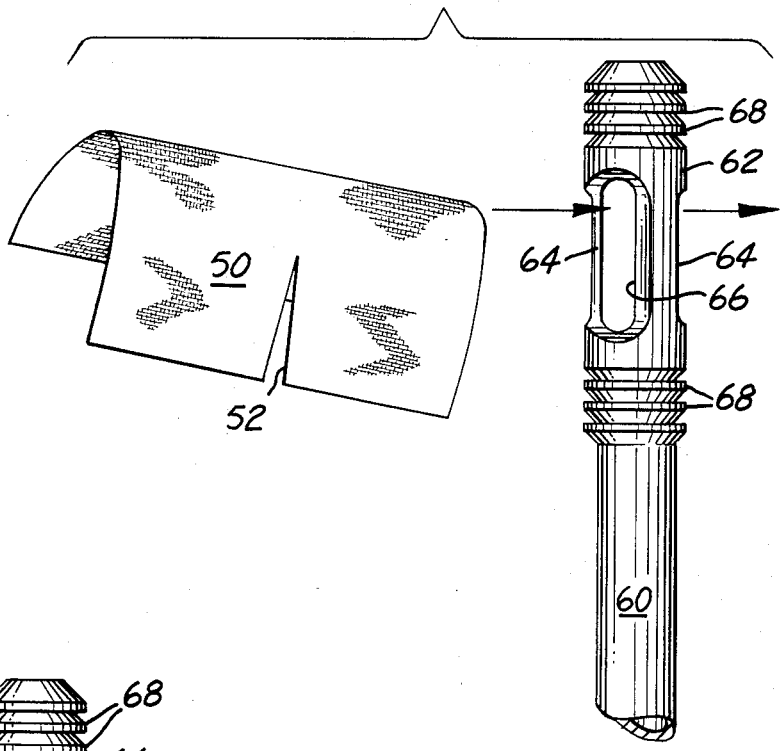
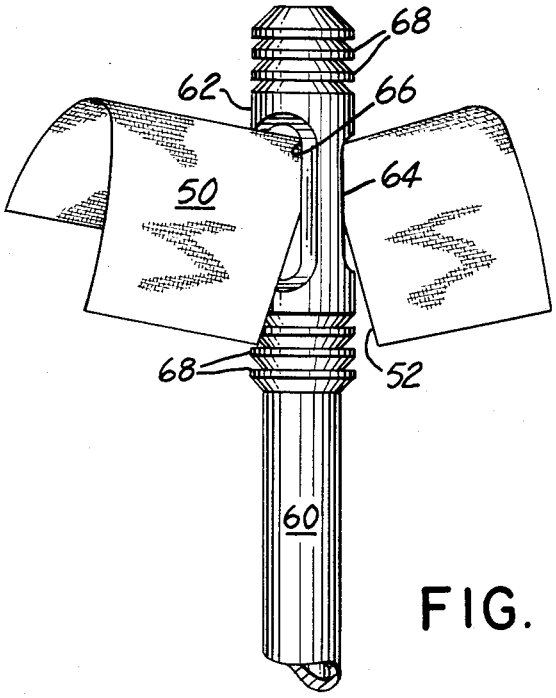
FIG. 13

TWO-WAY GUN CLEANER TIP AND BUTTERFLY PATH FOR USE THEREWITH

The present invention relates generally to new and useful improvements and structural refinements in cleaning or wiping rods and cooperant cleaning or wiping patches for rifled or smooth bore firearms having general utility in the arts, and more particularly aims to provide an improvement in the means for insuring a more efficient and complete cleaning of gun bores.

Without intending to place undue limitations upon the scope of the instant invention beyond what may be required by the state of the prior art, the particular embodiment shown may be briefly described as embracing the concept of more effectively bringing the patch into a more intimate contact with the wall of the gun bore as it is pushed or pulled therethrough in wiping strokes by means of its associated rod.

The primary object hereof is to improve the structure of cleaning or wiping rods and of cooperant cleaning or wiping patches as used for the function of cleaning firearm bores.

One salient purpose hereof is to provide simple, inexpensive and efficient rods and patches for use in firearms of either large or small type.

A further object is to provide an improved system of stroking a patch both in a forward stroke from muzzle to breech and in a return stroke from breech to muzzle while the firearm is being firmly gripped with one hand and the rod is being reciprocated with the other hand.

Another object is to provide a cleaning means which may be easily inserted in the firearm barrel or cylinder and as easily removed therefrom without the patch being released from the rod so as to be captured within the barrel or fall off upon exiting either end of the barrel or cylinder.

It will be apparent that the specific physical embodiment delineated, albeit the preferred exemplification, is only exemplary and explanatory of but one of a multiplicity of ways in and purposes for which the principles of the invention may be employed. The invention reverted to is not restricted or confined to this embodiment and is not intended to be exhaustive of, nor limiting of, the spirit or scope hereof. Rather it is submitted as the best known structural embodiment for the purpose of illustrating the invention and explaining the details of construction and arrangement of parts, in accordance with the patent statutes.

The invention is capable of receiving a variety of mechanical expressions, but it is to be expressly understood that the drawings are for the purpose of illustration only and are not to be construed as a definition of the limits of the invention, reference being had to the appended claims for that purpose.

In said drawings:

FIG. 11 is a view in perspective of the patch of the invention folded in half preparatory to insertion into the cleaning rod slot;

FIG. 12 is a view in perspective of the folded patch of the invention as it is about to be introduced to the slot of the rod; and FIG. 13 is a view in perspective showing the patch of the invention in its final position relative to the slot into which it has been introduced.

THE PRIOR ART SYSTEM

Figures 1, 2, 3, 4, 5, 6, 7, 8, 9, 10:
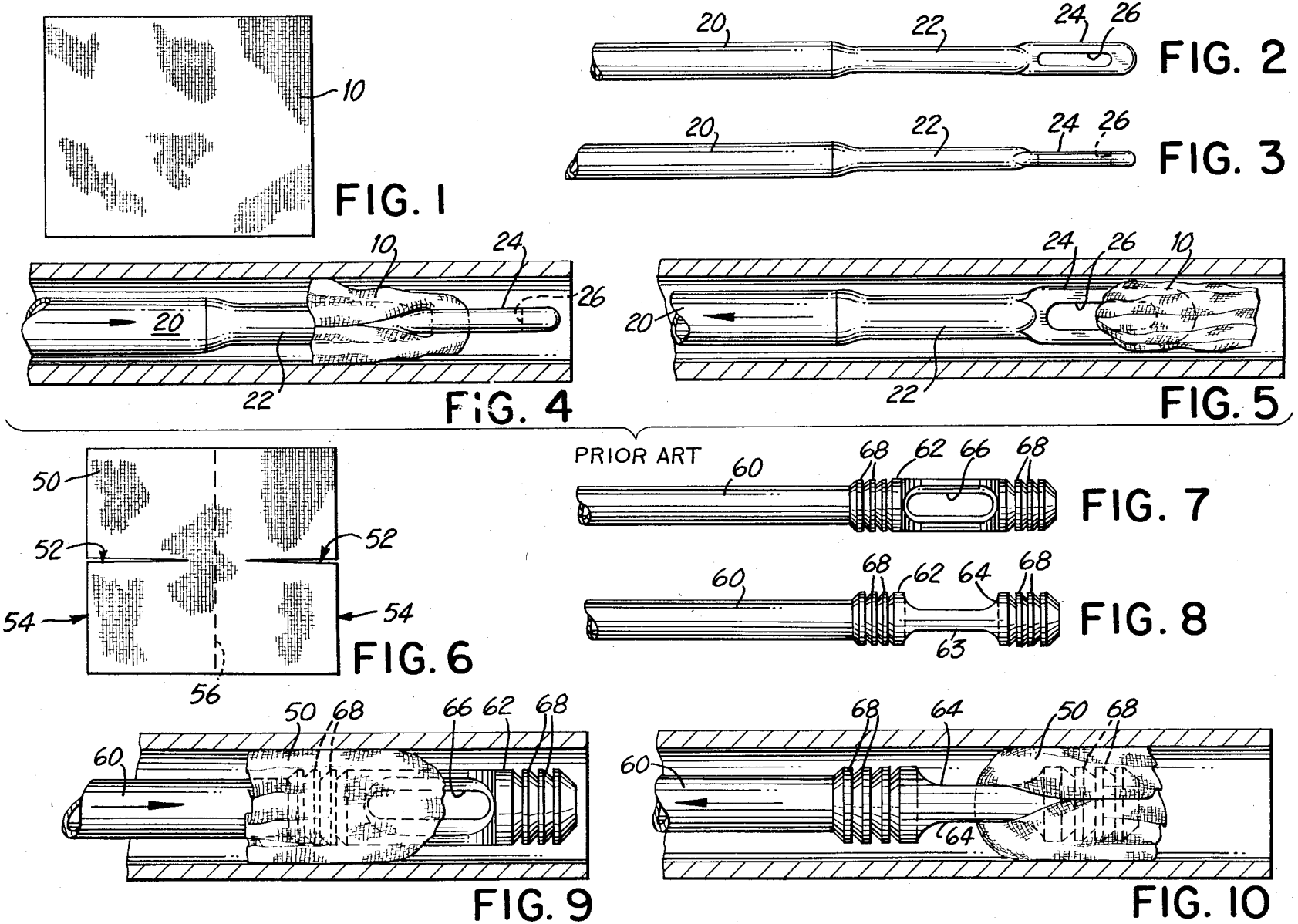
FIG. 10 PRIOR ART
FIG. 1 is a view in top plan of the patch of the prior art.
FIG. 2 is a fragmentary view in top plan of the cleaning rod of the prior art.
FIG. 3 is a fragmentary view in side elevational of the cleaning rod of the prior art.
FIGS. 4 and 5 are enlarged fragmentary sectional views of the patch and cleaning rod of the prior art being extended forwardly and rearwardly respectively in cleaning strokes through a gun barrel.
FIG. 6 is a view in top plan of the patch of the invention.
FIGS. 7 and 8 are fragmentary views in top plan and side elevation respectively of the cleaning rod of the invention.
FIGS. 9 and 10 are enlarged fragmentary sectional views of the patch and cleaning rod of the invention being extended forwardly and rearwardly respectively in cleaning strokes through a gun barrel.

In FIGS. 1–5, the prior art system of cleaning a firearm barrel is shown wherein numeral 10 designates the usual patch of square configuration and made from any suitable textile fabric such as muslin and measuring normally something in the order of 2 inches by 2 inches but varying according to different calibers being served.

20 designates a fragment of a cleaning rod provided at one end with the usual handle, not shown, and having its other end reduced in diameter at 22, flattened at its outboard terminus 24, and provided with a slot 26 for the reception therethrough of patch 10.

The outer end of the rod is normally rounded to prevent a patch from binding against it and interfering with the movement of the patch in following through the bore in either direction of movement.

The usual handle is mounted relative to rod 20 to allow the extension of the rod through a gun bore, the gun being held with one hand and the handle being held with the other hand. That is, the rod is extended into the bore and is manually driven forwardly from muzzle to breech and is subsequently pulled rearwardly in a return stroke from breech to muzzle. The reciprocating strokes may be continued a succession of times.

To prepare the patch for operational use, same is first folded in half, the so-folded patch being then inserted into and through the slot until a half of the folded patch extends radially outwardly of the slot from each side thereof.

The rod and supported patch are introduced into the muzzle. As the patch initially confronts the inner wall of the bore, the patch is caused to bend rearwardly in the direction of the operator. The narrowed dimension 22 of the rod terminus is such as to allow a draping of the patch over the rod but in a manner such that the patch may easily fail to snugly embrace the bore wall of the bore.

The more the rod is stroked in one direction, as shown in FIG. 4, or in the opposite direction, as shown in FIG. 5, the greater the tendency of the patch to drape more snugly around the rod and away from the bore wall whereat, of course, the wiping action ensues.

In FIG. 4, a moderately loose fit is shown as encountered in the inward stroke, and in FIG. 5, a completely loose fit is shown as being encountered in the outward stroke.

In the FIG. 5 showing particularly, attention is called to the minimum of rod surface which the patch has to bear upon with the result that the greater portion of the patch drags along rearwardly of the rod terminus with a minimum of its surface area in contact with the wall lining.

THE SYSTEM OF THE INVENTION

In FIGS. 6–10, the system of the invention is shown.

The patch 50, which may be of square, circular, rectangular, oval or other configuration, and which may be provided in strip form, if desired, is formed of a material and general surface area dimensions similar to prior art patch 10, is distinguished therefrom by the provision of a slit 52 extending inwardly from each opposite side 54 at the midpoint of said side. These slits extend inwardly toward each other, each terminating short of the patch center.

The dotted line 56 represents a fold line along which the patch will be initially folded to bring the pair of half parts into confrontation with each other when the patch is readied for operational use. See FIG. 11.

60 designates a cleaning rod, provided at one end with a usual handle (not shown), which handle is rotatable relative to the rod. More accurately, the rod is rotatable relative to the handle in the sense that as the handle is grasped by one hand of the user and is held stationary in operational use, the rod is free to rotate relative thereto as it follows the rifling or grooving of the firearm upon being stroked through the weapon.

The rod has at its other end an enlarged diameter at 62. Opposite sides of the mid-portion of the enlarged diameter 62 will be flattened so as to define a thinned or flattened portion 63 with opposite depressions 64 and through the thinned or flattened portion 63 a through slot 66 is provided.

At opposite ends of the thinned or flattened portion 63 a series of spaced peripheral annular oil retaining grooves 68 are provided around the enlarged rod diameter 62. The grooves function not only as oil storage reservoirs but also as means for ensuring against patch slippage.

As in the case of the prior art rods heretofore described, the handle is held fast by the operator as he urges his tool slowly through the gun bore in an opening stroke and then in retrograde manner in a closing stroke. Successive strokes are employed as needed.

Patch 50 is first folded in half along fold line 56, as shown in FIG. 11, and the patch is then introduced into the cleaning rod slot, care being taken first to insert the folded corner of the patch into the slot, as shown in FIG. 12. Only half of the patch is passed through the slot, so that the patch may be manually fluffed so as to define what I liken to a pair of extended wings on each side of the slot as is shown in FIG. 13.

So assembled, the patch and rod are then ready for introduction into the gun barrel or cylinder.

On being extended inwardly, the patch is enabled to be draped on all sides of the enlarged diameter rearwardly of the leading end of the rod and of the slot, as shown in FIG. 9.

Upon the return breech to muzzle stroke, as the cleaning rod is pulled in retrograde manner, the patch is caused to reverse itself and to then be draped over all sides of the enlarged diameter forwardly of the leading end of the rod and of the slot, as shown in FIG. 10.

The 4 wings allow maximum draping of patch fabric over the rod surface and in closer adjacency to the bore wall to a greater degree than in the case of the prior art devices thereby resulting in improved and more efficient cleaning action.

As shown in FIGS. 9 and 10, a greater portion of the patch is enabled to be draped over the enlarged diameter of the rod so as to ensure a closer proximity to the bore wall throughout the entireties of the inboard and outboard strokes of the rod/patch combination.

Incidentally, experimentation has shown that the use of a FIG. 1, prior art, patch with the rod of the invention results in a binding action of the patch between the bore wall and rod.

I claim:

1. In combination, a gun cleaner reciprocable in forward and retrograde wiping strokes through a gun barrel comprising:

a manually-engageable rod and a flexible planar gun cleaning patch cooperant therewith, the rod having an elongated longitudinal axis and having a certain diameter with a top at its outboard extremity of a diameter in excess of said certain diameter, the tip having at the midsection of its length a pair of diametrically-opposed indentations defining a central thinned portion having an axis coincident with the rod axis and a through patch-receiving slot extended centrally of the thinned portion and coaxial with the thinned portion axis and further defining outboard and inboard peripheral bearing surfaces adjacent the opposite extremities of the indentations, the patch being divisible into four quadrants by a first imaginary central fold line for folding the patch upon itself into a pair of confronting half-parts with each said half-part being divided into a pair of quadrants by a slit extending partially inwardly from its outer free side edge along a second imaginary central fold line intersecting the first fold line at right angles, the patch being extendable into the slot for the disposition of one of the quadrants of each pair outwardly of one side of the slot and the other of the quadrants of each pair outwardly of the other side of the slot for the draping of the inboard face of the patch for support by the inboard enlargement with the outboard face being exposed for the wiping function on the forward wiping stroke and for the draping of the outboard face of the patch for support by the outboard enlargement with the inboard face being exposed for the wiping function on the retrograde wiping stroke.

2. In combination a gun cleaner reciprocable in forward and retrograde wiping strokes through a gun barrel comprising:

a manually-engageable rod and a flexible planar gun cleaning patch cooperant therewith, the rod having an elongated longitudinal axis and having a certain diameter with a tip at its outboard extremity of a diameter in excess of said certain diameter, the tip having at the midsection of its length a pair of machined recesses at diametrically opposite sides thereof for defining a thinned portion with a through slot extended therethrough coaxially of the rod and further defining outboard and inboard circumferential bearing surfaces adjacent the opposite extremities of the indentations, the patch being foldable upon itself into a pair of confronting half-parts with each said half-part having a slit extending inwardly from its outer free side edge at the midpoint thereof for defining a pair of quarter parts, the patch being extendable into the slot for the disposition of one of the quarter parts of each pair outwardly of one side of the slot and the other of the quarter parts of each pair outwardly of the other side of the slot for the draping of the inboard face of the patch for support by the inboard enlargement with the outboard face being exposed for the wiping function on the forward wiping stroke and for the draping of the outboard face of the patch for support by the outboard enlargement with the inboard face being exposed for the wiping function on the retrograde wiping stroke.

* * * * *

UNITED STATES PATENT AND TRADEMARK OFFICE

CERTIFICATE OF CORRECTION

PATENT NO. : 4,499,625

DATED : February 19, 1985

INVENTOR(S) : C. Edward Bottomley

It is certified that error appears in the above—identified patent and that said Letters Patent is hereby corrected as shown below:

On title page, at item [54]
change "PATH" to "PATCH"

Column 1, at line 3, change "PATH" to "PATCH"

Signed and Sealed this

*Twenty-seventh* Day of *August 1985*

[SEAL]

*Attest:*

DONALD J. QUIGG

*Attesting Officer* *Acting Commissioner of Patents and Trademarks*